United States Patent [19]

Guilhem et al.

[11] 4,099,649

[45] Jul. 11, 1978

[54] APPARATUS FOR TRANSPORTING FLUIDS AT LOW TEMPERATURE

[75] Inventors: Jacques R. Guilhem, Sainte Adresse; Pierre Jean, Montivilliers, both of France

[73] Assignee: Gaz-Transport, Paris, France

[21] Appl. No.: 688,839

[22] Filed: May 21, 1976

[30] Foreign Application Priority Data

May 22, 1975 [FR] France ..... 75 15964

[51] Int. Cl.[2] ..... B65D 87/24; B63B 25/16

[52] U.S. Cl. ..... 220/439; 114/74 A; 270/429; 220/453; 220/901

[58] Field of Search ..... 220/91 G, 15, 69; 114/74 R, 74 T, 74 A

[56] References Cited

U.S. PATENT DOCUMENTS

| | | | |
|---|---|---|---|
| 3,095,107 | 6/1963 | Bergmann | 220/15 |
| 3,677,021 | 7/1972 | Bognaes et al. | 220/15 X |
| 3,680,323 | 8/1972 | Bognaes et al. | 220/15 X |
| 3,839,981 | 10/1974 | Gilles | 220/15 X |
| 3,841,253 | 10/1974 | Kircik et al. | 114/74 R |
| 3,842,775 | 10/1974 | Edwards et al. | 220/9 LG X |
| 3,853,240 | 12/1974 | Alleaume | 220/15 |
| 3,894,505 | 7/1975 | Murphy | 220/15 X |
| 3,899,988 | 8/1975 | Menendez | 220/9 LG X |
| 3,908,574 | 9/1975 | Miller et al. | 114/74 R |

FOREIGN PATENT DOCUMENTS

| | | | |
|---|---|---|---|
| 2,066,105 | 7/1971 | France | 220/9 LG |
| 1,317,676 | 11/1963 | France | 220/15 |

*Primary Examiner*—Stephen Marcus
*Attorney, Agent, or Firm*—Brisebois & Kruger

[57] ABSTRACT

Apparatus for transporting liquified gas at low temperature, a supporting structure containing a self-supporting fluid-type tank, an annular supporting ring, an annular plate, comprising a plurality of sliding joints between said annular plate and ring which permit said ring to expand and contract radially with respect to said plate.

14 Claims, 10 Drawing Figures

APPARATUS FOR TRANSPORTING FLUIDS AT LOW TEMPERATURE

SUMMARY OF THE INVENTION

It is well known that natural gas constitutes a highly developed source of substantial energy and is transported in a liquefied form at low temperatures. It is often carried by ship and it has already been proposed that ships be provided comprising self-supporting cylindrical tanks adapted to hold liquefied natural gas and to store said gas over a long period of time while satisfactorily restricting heat exchange with the exterior.

It has, however, been noted that such a construction does not provide the theoretical optimum of safety because the cylindrical shape of the tanks could advantageously be replaced by a spherical shape, which is preferable from the point of view of the strength of the materials.

French Pat. No. 2,168,674 already describes ships comprising self-supporting spherical tanks having at their bottoms a supported surface resting on a frusto-conical cradle fixed to the structure of the ship, sliding fasteners being provided in the equatorial plane of the tank. Such a construction presents certain difficulties from the point of view of manufacture and it is the object of the present invention to provide a means of transportation comprising such tanks in which the tank is supported from its equatorial zone. In the present description the term equatorial zone or equatorial plane means, for a curved tank the meridian of which is a curve having no sharp angles, the zone or plane containing the section of maximum diameter of the tank perpendicular to its axis of revolution.

Ships have already been described which comprise spherical tanks supported by the structure of the ship in their equatorial plane parallel to the plane of flotation of the ship. In these previous structures the sheet metal from which the tank is made is directly welded along the equatorial zone to metallic supports fixed to the hull of the ship. This type of construction is disadvantageous in that it is necessary to provide means for accommodating thermal contraction of the tank during its cooling to permit the transport of liquefied natural gas, which expansion produces substantial stresses in the zones connecting the tank to the structure of the ship. Moreover, the direct connection of the tank to the metallic supporting members results in considerable heat transfer so that such a construction is not satisfactory from the point of view of insulation.

It is an object of the present invention to provide transport means comprising tanks of revolution supported by the structure of the transport means along their equatorial zones by means of an assembly of connections which substantially reduce the heat exchange in the supporting zone permits expansion and contraction of the tanks due to temperature changes without causing undesirable stresses in the materials affected. The construction according to the invention also makes it possible to satisfactorily insure the support of the tank with respect to the structure of the transport means regardless of the movements or deformations of said structure.

It is accordingly an object of the present invention to provide, as a new article of manufacture, transport means and, in particular, a ship adapted for the transportation of liquefied gas at low temperature, said transport means comprising a supporting structure inside which at least one fluid-tight self-supporting tank is positioned, supported and maintained by said structure.

This tank defines a volume of revolution the meridian of which is a curve without any sharp angle and is fastened along its equatorial zone to an annular ring supported by an annular plate fixed to the supporting structure, a heat insulating layer being preferably provided all around the wall of the tank, and characterized by the fact that the connection between the annular ring and the annular plate is provided by means of a plurality of radially sliding joints.

In the preferred embodiment, the annular ring bears on the annular plate through spacers of a heat-insulating supporting material, said spacers being positioned between the sliding joints and having a thickness so great that the sliding joints do not serve as supports. The sliding joints are made of a female member having a U-shaped section and a rectangular male member. Between the male member and the female member of each sliding joint, on opposite sides of the male member, are sliding spacers of a heat insulating material. The sliding spacers and the supporting spacers positioned between the sliding joints are made of a wood inpregnated with a plastic material, for example, a laminate impregnated with epoxy resin. For each sliding joint the female member is fixed to the annular plate and the male member is fixed to the annular ring. The sliding joints are regularly distributed about the periphery of the tank. The annular ring has a transverse channel section the opening of which is closed by the wall of the tank. The annular ring is positioned tangentially with respect to the wall of the tank. The annular ring has a section which imparts great transverse rigidity thereto with respect to the strains due to torsion so that, when subjected to the loads and forces to which the tank is subjected during use, the maximum rotation of the transverse section of said annular ring is less than 1%, and preferably about 0.5%. The annular ring consists of a channel member, the free edges of the two sides of which are welded to the equatorial zone of the tank. The annular ring is filled with a particular heat insulating material. The equatorial zone of the tank has a greater thickness than the other parts of the wall of the tank. The annular plate is constituted by the upper surface of an annular casing supported by a plurality of posts, the base of which rests on the supporting structure of the transport means. The section of the annular casing is rectangular. The supporting posts of the annular casing are connected by cross-plates at their upper ends and welded at their lower ends to an annular base connecting a plurality of posts. The annular casing and the annular ring connected to the tank have transverse inner reinforcing walls regularly distributed about the periphery of the tank. When the transport means is a ship, the axis of revolution of the tank is perpendicular to the plane of floation of the ship and the meridian of the tank is circular.

The embodiment of the tank according to the invention makes it possible, due to the presence of the radially sliding joint positioned between the annular ring and the annular plate, for the tank to expand or contract with respect to the supporting structure in response to temperature changes. This avoids substantial heat strain, which makes it possible to avoid any rupture of the material and substantially increase the safety of the construction without undue expense, since it is not necessary to use special metals. Moreover, the radial distribution of the slides insures self-centering of the tank regardless of the mechanical tensions applied thereto or the thermal gradients imposed thereon.

The transverse section of the annular ring is preferably rectangular but it may have any other shape of equivalent inertia, whether square, circular or elliptical. Preferably the annular ring is positioned tangentially with respect to the sphere. The rigidity of the ring makes it possible to distribute uniformly the tensions resulting from deformations of the supporting structure, for example the hull of a ship, while suppressing completely any local concentration of the load. The sliding joints assure the resistance of the tanks to forces developed by movement of the supporting structure, for example, in the case of a ship, by pitching and rolling. The shear stresses developed in the course of these movements are absorbed by the sliding joints.

It should be noted that the heat transfer between the annular ring and the annular plate is greatly reduced, on the one hand, because of the use of insulating supporting spacers between the annular ring and the annular plate and, on the other hand, because of the use of sliding spacers between the male and female members of each sliding joint. There is thus no direct thermal connection between the wall of the tank and the supporting structure, a heat insulating member being interposed in all the heat transfer paths. This arrangement makes it possible to use an annular plate made of ordinary steel, whereas in the constructions of the prior art the supporting members connected to this sphere by welding must be made of special and expensive metal. The invention thus makes it possible to provide, at a reasonable price, a solution to all the thermal and mechanical requirements involved in the construction of self-supporting spherical tanks for the transportation of liquefied gas by ship.

In order that the invention may be better understood, a preferred embodiment thereof will now be described, purely by way of illustration and example, with reference to the accompanying drawing, on which:

Figure 1:
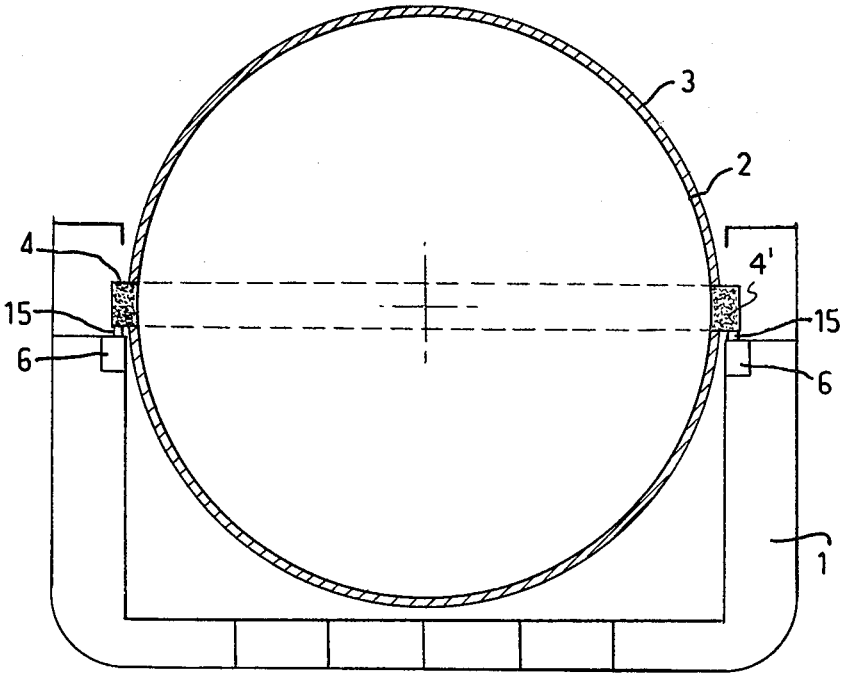
FIG. 1 is a schematic transverse sectional view taken through the structure of a ship, said section passing through the center of a spherical tank inside the ship.
Figure 8:
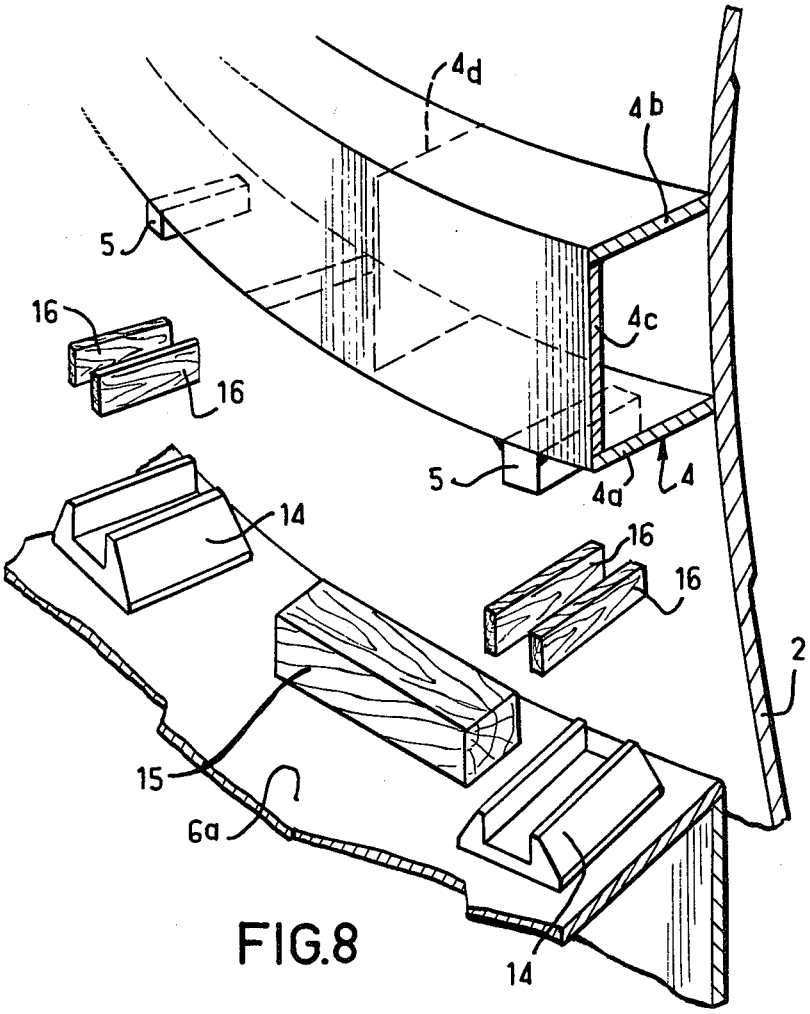
FIG. 8 is an exploded perspective view showing the connecting means and the supporting means interposed between the annular plate and the annular ring of the tank of FIG. 1.

Referring now to the drawings, it will be seen that reference numeral 1 indicates the hull of a ship according to the invention. The ship comprises several identical spherical tanks such as the one indicated by reference numeral 2 in FIG. 1, these tanks being positioned so that their centers are aligned along the longitudinal median plane of the ship. The tanks 2 are made of sheet metal, the equatorial zone parallel to the plane of flotation of the ship having, in the case of each tank, a wall thickness slightly greater than the thickness of the other parts of the tank, as is clearly shown on FIG. 8. Each tank 2 is encircled by a layer of heat insulating material 3, consisting for example of a plastic foam material of the type sold under the trademark STYROFOAM. Attached to the equatorial zone of each tank 2 is an annular toroidal ring 4 which consists of a channel member extending around the periphery of the equatorial zone of the tank 2 and welded to said equatorial zone at the free ends of the sides 4*a*, 4*b* of the channel member. The two sides 4*a*, 4*b* are connected to each other by the bottom 4*c* of the channel member and from point to point by radially positioned transverse reinforcing walls 4*d*. The channel member constituting the annular ring 4 is formed by welding sheets of steel constituting the two sides 4*a*, 4*b*, the bottom 4*c* and the transverse reinforcing walls 4*d* of the ring. As best seen in FIG. 8, male sliding members 5 are welded at regular intervals to the lower wall 4*a* of the annular ring. These consist of parallelopipedic rectangles, the major dimension of which is radially directed. The inside of the annular ring 4 is filled with a heat insulating material 41 commercially known as Perlite.

Figure 4:
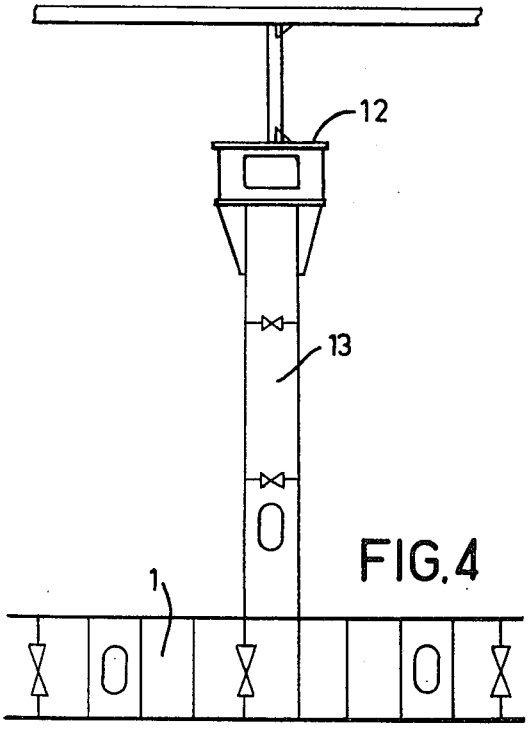
FIG. 4 is a sectional view taken along the line IV—IV of FIG. 2.
Figure 7:
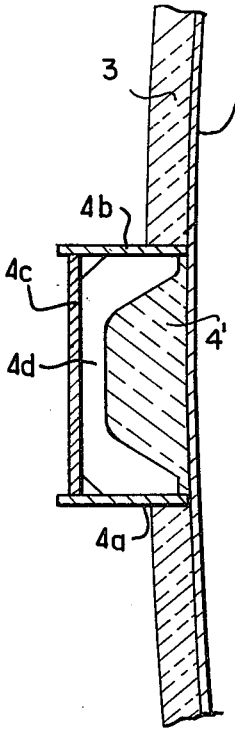
FIG. 7 is a detail view showing a transverse section through the annular ring associated with spherical tank of FIG. 1.
Figure 3:
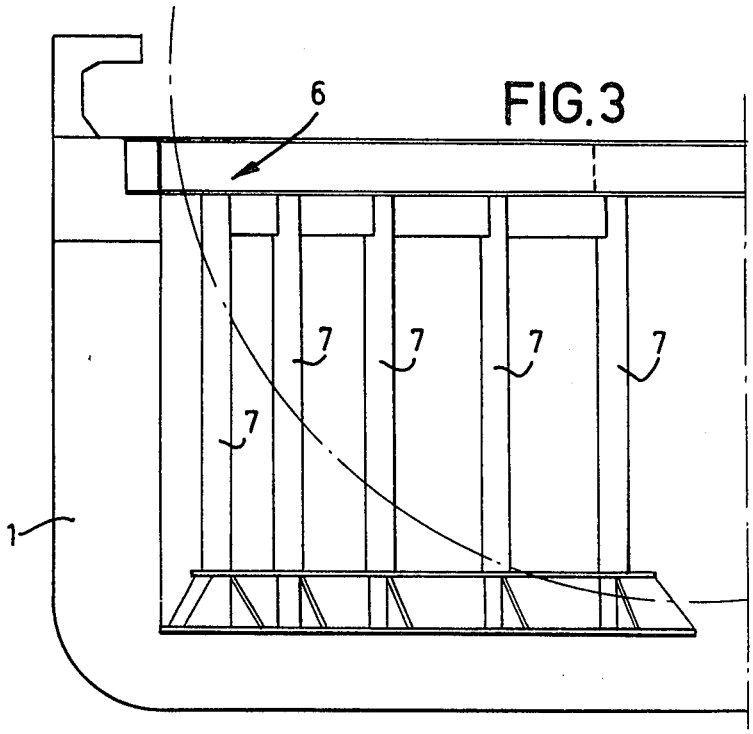
FIG. 3 is a schematic elevational view taken along the line III—III of FIG. 2.
Figure 2:
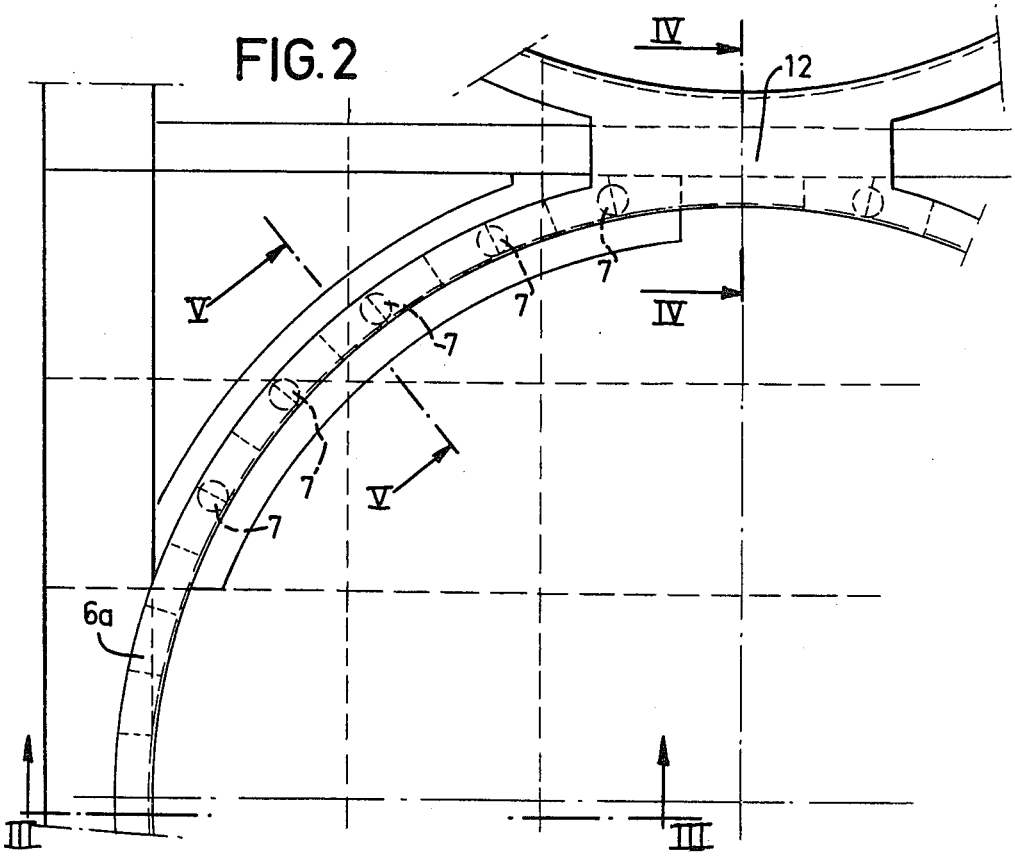
FIG. 2 is a schematic partial plan view of the annular plate which supports the spherical tank of FIG. 1.
Figure 6:
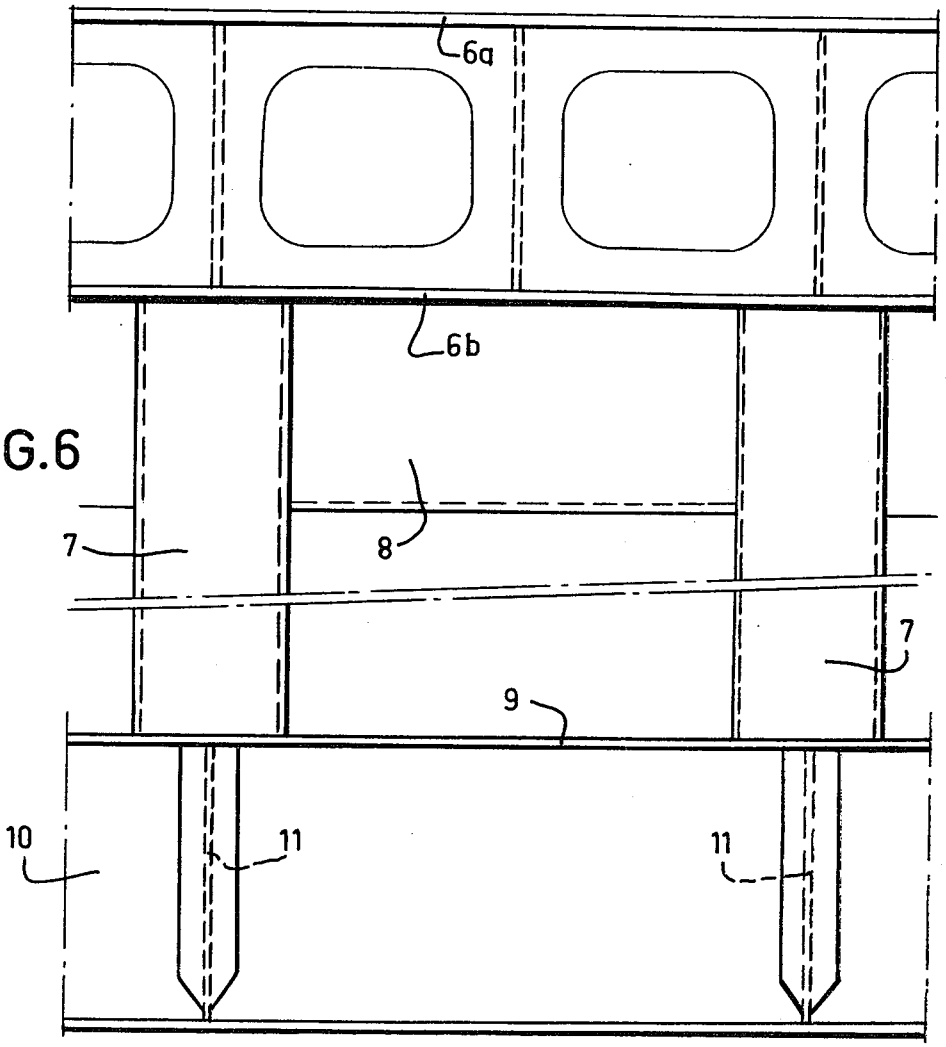
FIG. 6 is an elevational view taken along the line VI—VI of FIG. 5.
Figure 5:
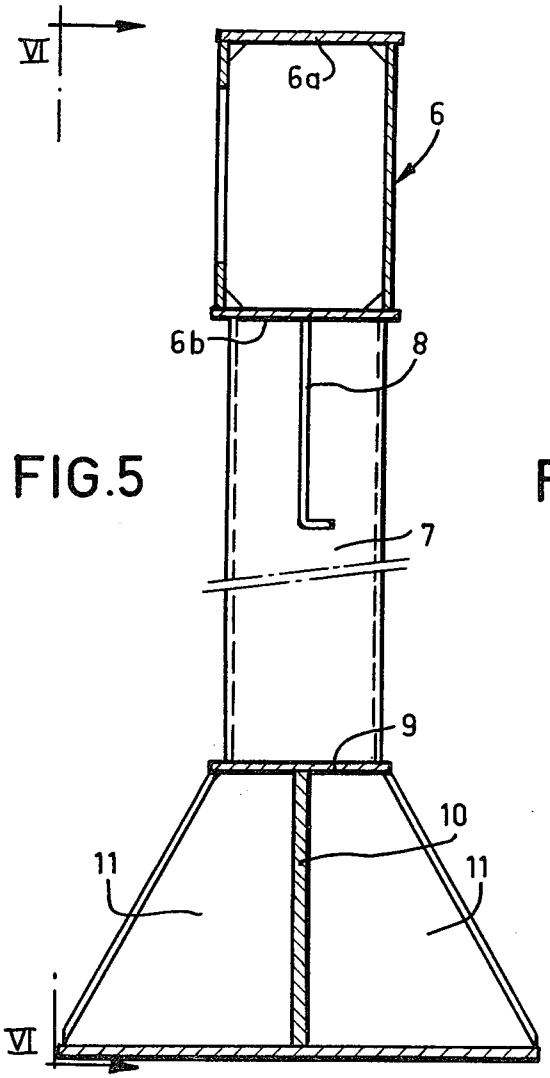
FIG. 5 is a detail view of a section taken along the line V—V of FIG. 2.
Figure 9:
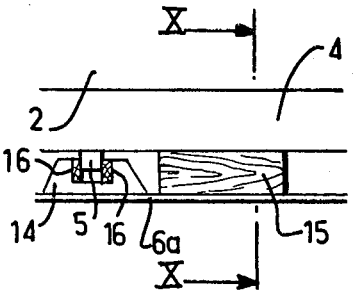
FIG. 9 is a schematic detail view of a slide and a supporting spacer interposed between the annular plate and the annular ring.
Figure 10:
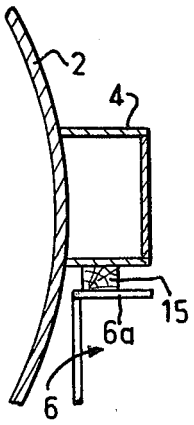
FIG. 10 is a schematic sectional view taken along the line X—X of FIG. 9.

The annular ring 4 is supported by an annular plate 6*a* forming the upper surface of an annular casing 6 having a rectangular section. This annular casing is supported by a plurality of posts 7 (FIG. 5) regularly distributed about the tank 2. The posts 7 are symmetrically positioned with respect to the longitudinal median plane of the ship and there are five of them in each 90° sector of the annular casing 6. The posts 7 are connected to each other at their upper ends by cross-plates 8, the lower part of which is bent at a right angle to form a flange. These cross-plates are welded to the lower surface 6*b* of the annular casing 6. The posts 7 of a 90° sector are also connected to each other at their lower ends by a base member 9 constituting the upper part of an I-beam, the web of which is indicated by reference 10 on the drawings. The lower arm of this I-beam rests on the bottom wall of the ship's hull and the beam is reinforced by stiffening ribs 11 perpendicular to the web 10. In the zones in which the two annular casings 6 associated with two adjacent tanks 2 approach each other so as to become practically tangent, the two casings 6 are connected by a single member 12 as shown in FIGS. 2 and 4, the member 12 being carried by the upper part of a transverse wall 13 forming part of the structure of the ship. The female members 14 of the sliding joint are welded to the annular plate 6*a*. The longitudinal median line of these female members is parallel to the plane of the plate 6*a* and intersects the axis of the tank 2 which is perpendicular to the plane of flotation of the ship. The female members 14 of the slide are positioned in alignment with the male members 5 associated with the annular ring 4. Each female member 14 of the slide has a rectangular sliding section, the width of channel in the female member being slightly greater than the width of the male members 5.

Annular ring 4 is supported by the annular plate 6*a* through supporting spacers 15 positioned around the tank 2 between the sliding joints 5–14, with the space between each two sliding joints 5–14 being provided with a spacer 15. The spacers 15 have a substantially rectangular section and consist of laminated beechwood impregnated with epoxy resin, this material being sold under the trademark PERMALI. The spacers 15 have a strength which permits them to support the entire weight of the tanks 2 after the tanks are filled and they constitute an excellent heat insulator. Between each male member 5 of the sliding joint and the sides of the channel in the female member 14 thereopposite, a spacer 16 is interposed, this spacer consists of a rectangular plate made of the same material as the spacers 15. The joint spacers 16 prevent any transverse play between the male member 5 of the slide and the female member 14. The height of the spacers 16 is such that they do not extend above the sides of the female member 14 of the sliding joint. The height of the spacers 15 is such that the lower surface of the male members 5 of the sliding joint do not bear on the bottoms of the female members 14 of the sliding joint and the lower wall 4*a* of the annular casing 4 does not bear on the upper surface of the sides of the female members 14 of the sliding joint. Under these conditions the sliding joints do not act as supports and the entire weight of the tank 2 is supported by the spacers 15. The interposition of the sliding spacers 16 on opposite sides of the male members 5 of the sliding joints makes it possible to cut the heat transfer paths which might be established between the two members of a sliding joint and greatly improve, as a consequence, the heat insulating of the tank 2.

It should be noted that when the tank 2 is cooled, and consequently undergoes thermal contraction, this results in sliding of the male members 5 and the female members 14 without any strain on the material since the contraction of the tank can take place freely. Moreover, the support for the spherical tanks 2 with respect to the structure of a ship is provided by the cooperation between the members 5 of the sliding joints and the sides of the members 14. The strains developed as a result of the movement of the ship take the form of shear forces in the members of the slide. These members are numerous around the tank 2 so that the tank is held in position without difficulty. The radial arrangement of the slides permits self-centering of the tank regardless of the mechanical forces and thermal gradients imposed.

The transverse section of the annular ring 4 is so selected that the ring has a great transverse rigidity and that, in response to the torsion engendered by the multiple pressures on the spacers 15, the maximum rotation of the sections of the annular ring remains small, of the order of 0.5° for example. This rigidity of the annular ring makes it possible to uniformly distribute the stresses resulting from the deformations of the hull 1 of the ship, which prevents any local concentration of the load.

The heat losses through the annular equatorial ring are reduced because the ring 4 is filled with a heat insulating material. The heat losses in the zone in which the tank is supported are extremely low because of the good heat insulation provided by the material of which the supporting spacers 15 and the sliding spacers 16 are made.

It will, of course, be appreciated that the embodiment hereinbefore described has been given purely by way of illustration and example and may be modified as to detail without thereby departing from the basic principles of the invention.

What is claimed is:

1. In a device for transporting liquefied gas at low temperature, said device comprising a supporting structure, at least one fluid-tight, self-supporting tank defining a volume of revolution the meridian of which is a curve free from sharp angles, said tank having an equator, a ring fixed to the supporting structure and supporting said tank, spacers made of a heat insulating material positioned between said ring and said tank, a plurality of circumferentially distributed radial slides positioned between said spacers and connecting said tank to said ring, said spacers having a thickness such that said tank is supported on said spacers rather than said slides, said slides each comprising:

a female element having a U-shaped opening and a male element extending into the female element and of a size smaller than the U-shaped opening so that there are spaces between the sides of each male and female element, and guides of insulating material in said spaces between each male and female element to minimize heat loss at the slides;

an insulating layer encircling the wall of the tank, a hollow toroidal member encircling said tank at said equator, and having portions thereof on opposite sides of the equator secured to said tank, said toroidal member being filled with an insulating material and supported by said spacers on the ring fixed to the supporting structure, said toroidal member having a transverse section which imparts a transverse rigidity thereto such that, when subjected to torques by those loads and forces to which the tank is subjected during use, the maximum rotation of said transverse section is less than one degree.

2. Device as claimed in claim 1 in which said spacers are of a heat insulating material and made of wood impregnated with a plastic material.

3. Device as claimed in claim 1 in which the female members of said sliding joints are fixed to said annular plate and said male members are fixed to said annular ring.

4. Device as claimed in claim 1 in which the sliding joints are regularly distributed about the periphery of the tank.

5. Device as claimed in claim 1 in which said toroidal member has a channel section closed by the wall of said tank.

6. Device as claimed in claim 1 in which said toroidal member has a transverse rigidity sufficient to prevent rotation of any transverse section of said member through an angle as great as 0.5° in response to the strains to which said tank is subjected.

7. Device as claimed in claim 1 in which said toroidal member is a channel member of C section, the two sides of which are welded to the equatorial zone of the tank, respectively above and below the equator.

8. Device as claimed in claim 1 in which the equatorial zone of the tank is thicker than the remainder of the tank wall.

9. Device as claimed in claim 1 comprising an annular casing the top of which constitutes said annular ring, a plurality of posts supporting said casing, and a base supporting said posts.

10. Device as claimed in claim 9 in which said casing is rectangular in section.

11. Device as claimed in claim 9 comprising crossplates connecting the upper ends of said posts and an annular base connecting the lower ends thereof.

12. Device as claimed in claim 11 comprising transverse reinforcing walls in said annular casing and said annular ring.

13. Device as claimed in claim 1 mounted in a ship with the axis of the volume of revolution of the tank perpendicular to the plane of flotation of the ship.

14. Device as claimed in claim 13 in which the meridian section of said tank is circular.

* * * * *